US007591110B2

(12) United States Patent
Lane

(10) Patent No.: US 7,591,110 B2
(45) Date of Patent: Sep. 22, 2009

(54) BUILDING FOUNDATION

(75) Inventor: Jody B. Lane, Florence, SC (US)

(73) Assignee: Advanced Building Concepts, LLC, Florence, SC (US)

( * ) Notice: Subject to any disclaimer, the term of this patent is extended or adjusted under 35 U.S.C. 154(b) by 198 days.

(21) Appl. No.: 11/705,200

(22) Filed: Feb. 12, 2007

(65) Prior Publication Data

US 2008/0110114 A1 May 15, 2008

Related U.S. Application Data

(60) Provisional application No. 60/858,035, filed on Nov. 10, 2006.

(51) Int. Cl.
*E02D 27/00* (2006.01)

(52) U.S. Cl. ..... 52/293.2; 52/292; 52/293.1; 52/293.3; 52/295; 52/297

(58) Field of Classification Search ..... 52/292, 52/293.1, 293.2, 293.3, 295, 297
See application file for complete search history.

(56) References Cited

U.S. PATENT DOCUMENTS 1,704,255 A * 3/1929 Lewis ..... 52/293.2
2,835,126 A * 5/1958 Paolella ..... 52/169.14
3,002,322 A * 10/1961 Dorsett ..... 52/223.7
3,122,223 A * 2/1964 Chell et al. ..... 52/295
3,537,220 A * 11/1970 Ellis ..... 52/223.5
4,413,456 A 11/1983 Gilb
4,426,815 A 1/1984 Brown
4,452,028 A * 6/1984 Norton et al. ..... 52/742.14
4,726,567 A * 2/1988 Greenberg ..... 256/19
4,838,737 A 6/1989 Quimby
5,007,218 A * 4/1991 Bengtson et al. ..... 52/204.2
5,560,172 A * 10/1996 Brophy et al. ..... 52/596
5,735,090 A * 4/1998 Papke ..... 52/220.2
5,794,921 A * 8/1998 Greenberg ..... 256/19
6,632,048 B2 * 10/2003 Greenberg ..... 405/284
6,705,583 B2 3/2004 Daniels et al.
7,003,918 B2 2/2006 Williams (Continued)

OTHER PUBLICATIONS http://www.strongtie.com/products/cfs/mas.html; visited Jan. 15, 2007; Author Simpson Strong-Tie Co., Inc.; (4 pages).

(Continued)

*Primary Examiner*—Richard E Chilcot, Jr.
*Assistant Examiner*—Mark R Wendell
(74) *Attorney, Agent, or Firm*—J. Bennett Mullinax, LLC

(57) ABSTRACT

A building foundation is provided. The building foundation includes a footing and a foundation wall supported by the footing. The foundation wall has a plurality of cells arranged to define a set of aligned cell cavities. The plurality of cells are arranged to define a top row of cells. At least some of the cells of the top row of cells have a cross-sectional shape that is the same as at least some of the cells of a lower row of cells of the foundation wall. A sill anchor is at least partially located in the set of aligned cell cavities of the foundation wall. Grout is disposed in the set of aligned cell cavities between the sill anchor and the footing. The sill anchor is configured for attachment to a sill.

24 Claims, 6 Drawing Sheets

U.S. PATENT DOCUMENTS

| | | | | |
|---|---|---|---|---|
| 7,017,318 | B1 * | 3/2006 | Hohmann et al. | 52/562 |
| 7,188,453 | B2 * | 3/2007 | Greenberg et al. | 52/223.7 |
| 2002/0078646 | A1 * | 6/2002 | Eaton | 52/292 |
| 2005/0097849 | A1 * | 5/2005 | Hayes | 52/698 |
| 2005/0252144 | A1 * | 11/2005 | MacDonald et al. | 52/598 |

OTHER PUBLICATIONS

Catalog C-HW05; pp. 17, 20 and 31; Copyright 2005; Author Simpson Strong-Tie Co., Inc.; (3 pages).

2003 International Residential Code; pp. 61-63 and 75; Copyright 2003; Author International Code Council; (4 pages).

2003 International Residential Code; Sections R404.1.1, R404.1.4 and R404.1.5.1; Copyright 2003; Author International Code Council; (2 pages).

2003 International Residential Code; Section R403 and Tables R404.1.1(1), R404.1.1(2), R404.1.1(3), R404.1.1(4); Copyright 2003; Author International Code Council; (13 pages).

2003 International Residential Code; Sections R606.5 and R703.7; Copyright 2003; Author International Code Council; (4 pages).

* cited by examiner

BUILDING FOUNDATION

CROSS REFERENCE TO RELATED APPLICATION

This application claims the benefit of U.S. application Ser. No. 60/858,035 filed on Nov. 10, 2006 and entitled, "Building Foundation." U.S. application Ser. No. 60/858,035, including all incorporated appendices, is incorporated by reference herein in its entirety for all purposes.

FIELD OF THE INVENTION

The present invention relates generally to a building foundation construction. More particularly, the present application is directed to a building foundation that has a crawl space and that has a foundation wall without the presence of a bond beam.

BACKGROUND

Buildings, such as houses, typically have foundations made from various types. Slab foundations may be used in which anchor bolts or MSA anchors are embedded into a concrete slab and have a bottom plate attached thereto. The bottom plate is the portion of the foundation onto which vertical members such as the walls of the structure are attached. Alternative arrangements are possible in which a sill anchor is embedded in the slab and is nailed into the bottom plate in order to hold the bottom plate in place. Another foundation type commonly employed is found in the construction of vinyl sided homes. These foundations include a brick foundation wall reinforced along its length by a plurality of piers. The sill is located on top of the brick foundation wall. A third type of building foundation is found in homes made of brick. Here, a foundation wall made of concrete blocks rests behind a face brick wall that makes up the exposed, viewable side of the house. The sill is located on top of the concrete wall.

The foundations in brick homes generally include a bond beam that makes up the top portion of the foundation wall. The upper cells of the foundation wall define a U-shaped channel that runs the length of the foundation wall. A horizontally oriented piece of rebar is disposed in and runs the length of the U-shaped channel. Grout is poured into the U-shaped channel to complete formation of the bond beam which in turn strengthens the resulting foundation. Although capable of strengthening a building foundation, bond beams are problematic in that they increase the amount of labor and cost associated in building the resulting foundation. Additionally, the bond beam is usually inspected prior to allowing a framer to begin construction on top of the sill. Such an inspection of the bond beam increases the cost of construction and can cause delays in finishing.

It is also known to employ seismic straps in building foundations in order to provide strength during shaking of the house in an earthquake. A typical seismic strap is a galvanized steel member 3/16 inches thick and 2 inches wide. The seismic strap is embedded in the concrete footing of the building foundation and runs vertically through an aligned series of cells of the concrete foundation wall. The seismic strap emerges from the top of the foundation wall and is nailed into the sill. A series of seismic straps can be present along the length of the foundation wall and spaced no greater than 6 feet on center from one another and 1 foot from the corners in various designs. When used in foundations for vinyl sided homes, a pair of seismic straps are included in every pier.

Although suitable for their intended purpose, seismic straps are problematic in that the mason must, when building the concrete foundation wall, maneuver concrete cells around the seismic straps. Further, the seismic straps must be precisely positioned in order for the aligned series of cells to be properly disposed around the seismic straps across the entire length of the foundation wall. An error in spacing of either the seismic straps or the cells will require the mason break one or more cells in order to complete construction of the foundation wall. The use of seismic straps may therefore result in the loss of time and money and could potentially result in a foundation that is not structurally sound. Additionally, seismic straps are generally formed via a stamping process that results in sharp edges along the sides and top thereof. Sharp edges of this sort cause injury to workers in construction of the foundation wall. Further, the sharp edges have a tendency to cut string positioned along the foundation wall that is used when laying concrete block. The cost and time of construction of foundation walls thus occur. Accordingly, there remains room for variation and improvement within the art.

SUMMARY

Various features and advantages of the invention will be set forth in part in the following description, or may be obvious from the description, or may be learned from practice of the invention.

One aspect of an exemplary embodiment is provided in a building foundation that has a footing and a foundation wall supported by the footing. The foundation wall has a plurality of cells arranged to define aligned cell cavities at least some of which are filled in with grout. At least some of the cells of the top row of cells of the foundation wall have a cross-sectional shape that is the same as at least some of the cells of a lower row of cells of the foundation wall. A seismic strap is at least partially located in at least one set of the aligned cell cavities filled in with grout. The seismic strap is embedded in the footing. A sill is supported by the foundation wall. The seismic strap is attached to the sill.

Another aspect of an exemplary embodiment is found in a building foundation as immediately discussed in which two pieces of horizontally disposed rebar are located in the footing. Vertically disposed rebar is located in the set of aligned cell cavities filled in with grout in which the seismic strap is located.

An additional aspect of another embodiment resides in a building foundation as immediately discussed in which the seismic strap contacts the vertically disposed rebar. The vertically disposed rebar contacts one of the pieces of horizontally disposed rebar.

A further aspect of one exemplary embodiment exists in a building foundation that has a footing and a foundation wall supported by the footing. The foundation wall has a plurality of cells. The top row of cells does not include a bond beam. Also, the foundation wall does not include a seismic strap therein. A sill anchor is at least partially located in the foundation wall. The sill anchor is configured for attachment to a sill.

Another aspect of a further exemplary embodiment is found in a building foundation as immediately discussed in which the plurality of cells are arranged to define a set of aligned cell cavities. The sill anchor is at least partially located in an upper cell of the set of aligned cell cavities and is embedded in grout that fills the set of aligned cell cavities.

An additional aspect of another exemplary embodiment includes a building foundation as immediately discussed in which vertically disposed rebar is embedded in the footing and is located in the set of aligned cell cavities in which the sill anchor is located. The vertically disposed rebar is embedded in grout that fills the set of aligned cell cavities.

One aspect of another exemplary embodiment resides in a building foundation as previously mentioned in which the sill anchor has an elongated portion with a hooked end. Also, the sill anchor has a formable portion that includes a pair of ears that are capable of being formed.

A further aspect includes an exemplary embodiment of a building foundation that has a footing and a foundation wall supported by the footing. The foundation wall has a plurality of cells arranged to define a set of aligned cell cavities. The plurality of cells are arranged to define a top row of cells. At least some of the cells of the top row of cells have a cross-sectional shape that is the same as at least some of the cells of a lower row of cells of the foundation wall. A sill anchor is at least partially located in the set of aligned cell cavities of the foundation wall. Grout is disposed in the set of aligned cell cavities between the sill anchor and the footing. The sill anchor is configured for attachment to a sill.

Another aspect provides for an exemplary embodiment of a building foundation as previously discussed that further includes a vertically disposed rebar embedded in the footing and located in the set of aligned cell cavities in which the sill anchor is located. The vertically disposed rebar is embedded in grout in the set of aligned cell cavities.

An additional aspect resides in an exemplary embodiment as mentioned prior in which the foundation wall does not include a seismic strap therein.

A further aspect includes an exemplary embodiment in which the sill anchor has a hooked end and a formable portion with a pair of ears. The hooked end of the sill anchor is embedded in grout that is included in the foundation wall. The ears of the sill anchor are located outside of the foundation wall and have a plurality of apertures configured for receipt of nails for use in attaching the ears to a sill supported by the foundation wall.

A further aspect exists in an exemplary embodiment as described above that further includes a faced brick wall that is supported by the footing.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
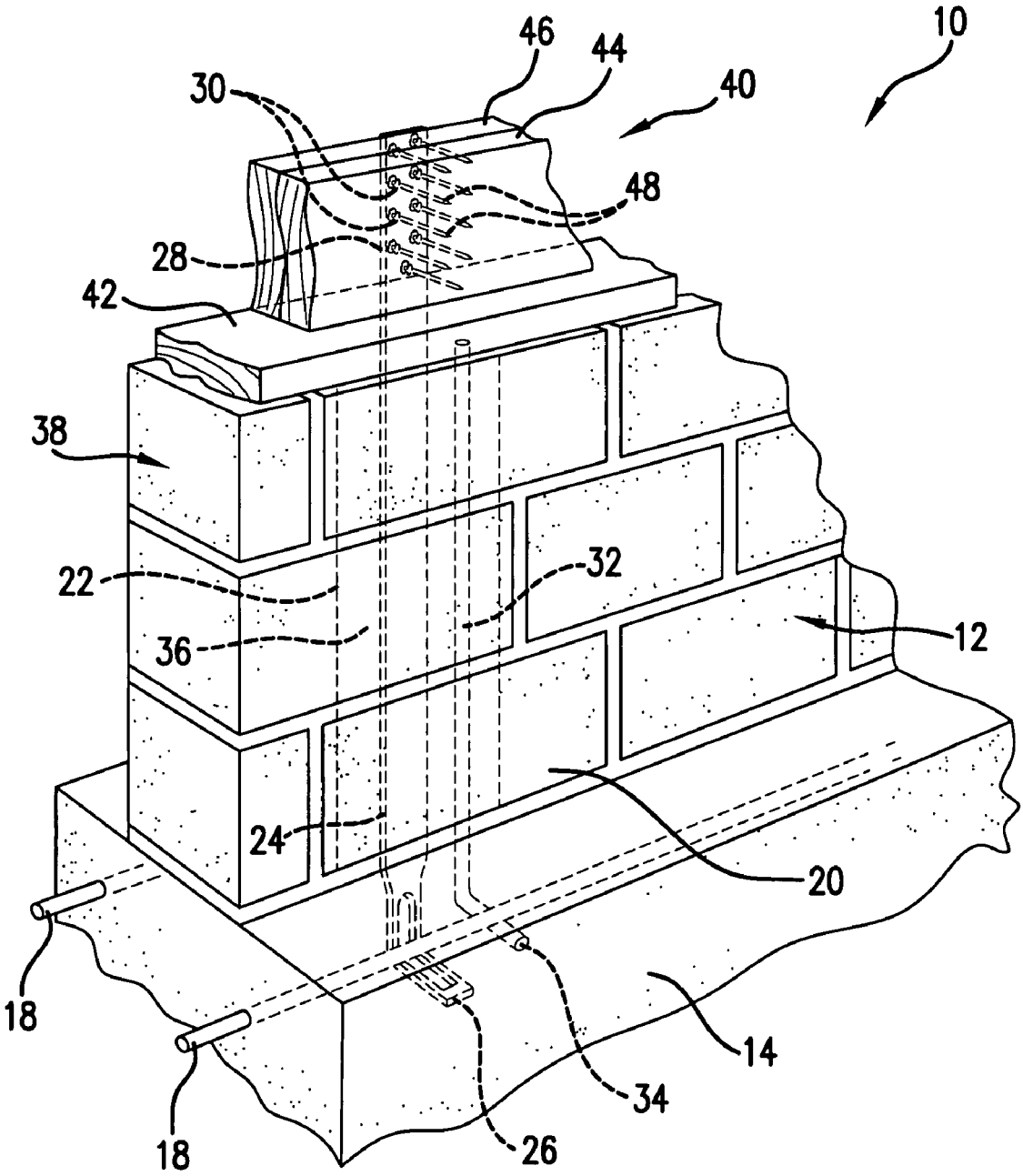
FIG. 1 is a perspective view of a portion of a building foundation that includes a seismic strap in accordance with one exemplary embodiment of the present invention.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a building foundation 10 used in the construction of structures such as homes. The building foundation 10 may be used in the construction of brick homes in accordance with various exemplary embodiments. The building foundation 10 employs a design that eliminates the presence of a bond beam in the top row of cells 38 in the foundation wall 12 of the building foundation. Other embodiments also exist in which seismic straps 24, commonly employed to prevent damage in earthquakes, are eliminated from the building foundation 10.

Figure 2:
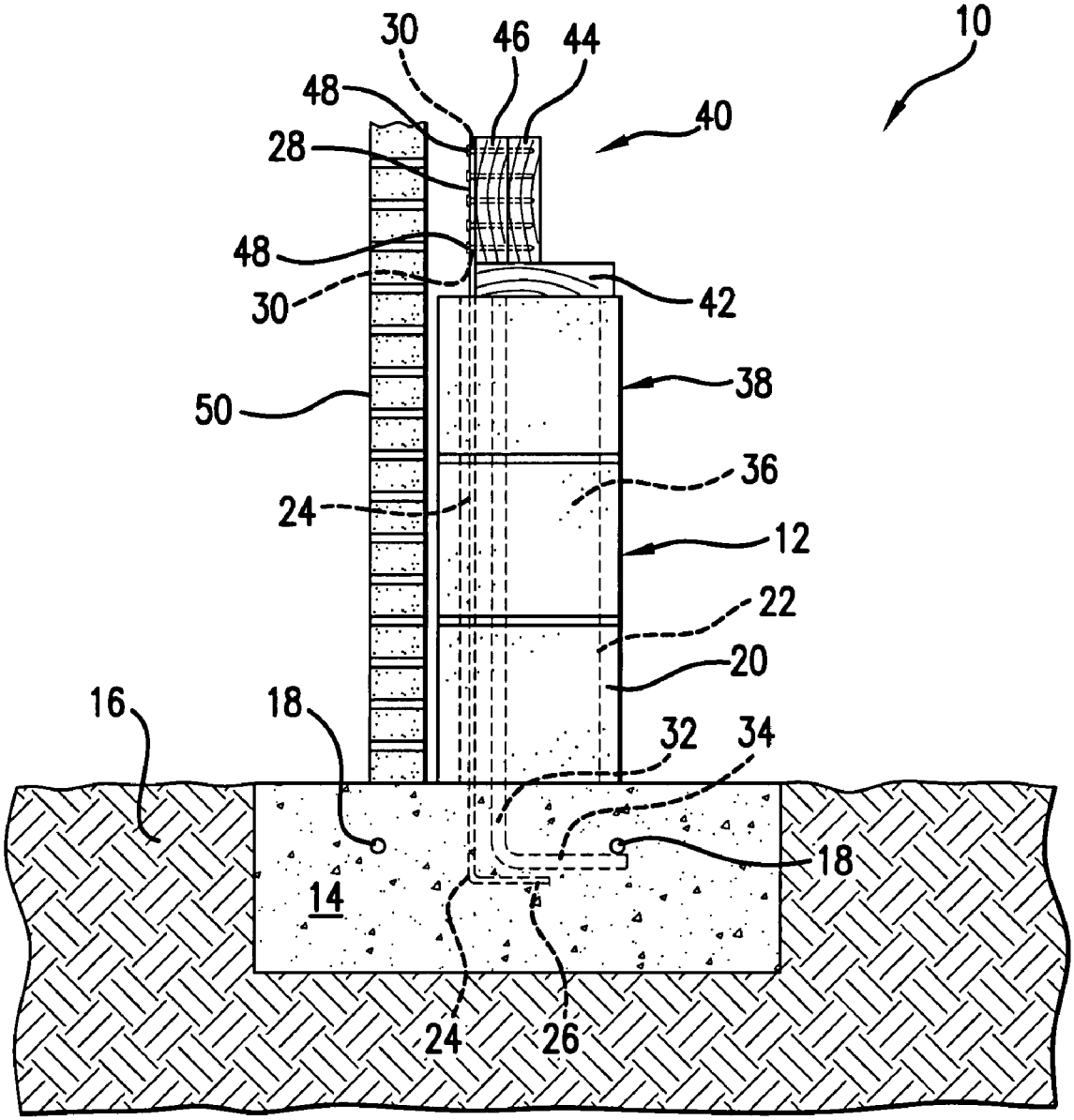
FIG. 2 is a side view of the building foundation of FIG. 1 that further includes a faced brick wall.

FIG. 1 is a perspective view of a building foundation 10 in accordance with one exemplary embodiment of the present invention. The building foundation 10 includes a foundation wall 12 that rests on a footing 14. Footing 14 can be a continuously solid structure or can be a fully grouted masonry or concrete structure. Two pieces of horizontal rebar 18 are present in footing 14 in order to provide reinforcing strength to the concrete or other material making up the majority of footing 14. Although shown as employing a pair of #4 rebar 18, it is to be understood that any number or type of rebar 18 may be used in accordance with other exemplary embodiments. Footing 14 is supported by soil 16 as shown in FIG. 2 which can be either undisturbed natural soil or engineered fill. In accordance with one exemplary embodiment, the foundation wall 12 rests on a maximum of 24 inches of unbalanced fill. The sizing and composition of footing 14 may be as that called for in Section R403 and Table R403.1 of the 2003 International Residential Code® set forth by the International Code Council in establishing construction standards.

The building foundation 10 also includes a foundation wall 12. The foundation wall 12 can be configured as that commonly known as a solid 8 inch wall. In accordance with the exemplary embodiment in FIGS. 1 and 2, the foundation wall 12 has a maximum height above grade of 48 inches. The foundation wall 12 can be made from a plurality of concrete cells 20 that include cavities therethrough. The cells 20 can have a length of 8 inches on one side so that the width of the resulting foundation wall 12 is 8 inches. The cells 20 can be arranged with respect to one another so that cavities between vertically adjacent upper and lower cells 20 line up with one another to form a set of aligned cell cavities 22. Although described as being made up of a number of concrete cells 20, it is to be understood that the foundation wall 12 can be constructed of other materials in accordance with other exemplary embodiments of the present invention. The cells 20 can be 8×8×16 inch block in accordance with one exemplary embodiment.

The building foundation in FIGS. 1 and 2 includes a seismic strap 24 located in the aligned cell cavities 22. Seismic strap 24 can be made of galvanized steel and may have a thickness of $3/16^{th}$ of an inch and a width of 2 inches. Seismic strap 24 has a lower angled portion 26 that is embedded in the footing 14. In certain embodiments, the lower angled portion 26 is embedded a minimum of 4 inches in footing 14. The seismic strap 24 can be placed within 1 foot from each corner of the foundation wall 12. The corners in this instance include both 90° corners and those that are not 90° such as those associated with bay windows. The seismic straps 24 can also be spaced a maximum of 6 feet on center from one another. Other embodiments exist in which seismic straps 24 are located every 4 feet on center from one another.

A piece of vertical rebar 32 is present in the same set of aligned cell cavities 22 as that which has the seismic strap 24. The vertical rebar 32 can be connected to the seismic strap 24. Alternatively, the vertical rebar 32 and seismic strap 24 need not be connected to one another. In a similar vein, the vertical rebar 32 and seismic strap 24 may or may not touch one another in accordance with various exemplary embodiments. The vertical rebar 32 functions so as to strengthen the foundation wall 12. Rebar 32 has a lower angled portion 34 that is embedded in the footing 14. In accordance with one exemplary embodiment, rebar 32 is #4 rebar and is located every 4 feet on center from one another. Further, the rebar 32 is located within 1 foot from corners including both 90° corners and those that are not 90° such as those associated with bay windows. The rebar 32 can be #4 rebar in accordance with other exemplary embodiments of the present invention. Additional seismic straps 24 are located in each of the subsequently aligned cell cavities 22 with the spaced rebar 32. The sets of aligned cell cavities 22 that house the seismic strap 24 and vertical rebar 32 are filled with grout 36 so that a solid structure is formed. The grout 36 employed can be selected so as to be capable of withstanding a minimum of 3000 pounds per square inch. The grout 36 used in the construction of foundation wall 12 in FIGS. 1 and 2 can be selected in order to withstand 3000 pounds per square inch. Other embodiments are possible in which the grout 36 can withstand at least a minimum of 2000 pounds per square inch. The exemplary embodiment of the foundation wall 12 shown in FIGS. 3 and 4 can be made with grout 36 capable of withstanding 2000 pounds per square inch.

The vertical rebar 32 need not be in the same set of aligned cell cavities 22 as the seismic strap 24. The aligned cell cavities will be filled with grout 36 if a seismic strap 24 or vertical rebar 32 is present. The two components can be in different sets of aligned cell cavities 22 in accordance with other exemplary embodiments. The seismic strap 32 can be located 6 feet from one another on center while the vertical rebar 32 can be located 4 feet on center from one another.

The building foundation 10 may be constructed in accordance with standards as those called for in section R404.1.1 of the 2003 International Residential Code® set forth by the International Code Council in establishing construction standards that deals with the construction of masonry foundation walls. Additionally or alternatively, the building foundation 10 may be made in accordance with the specifications set forth in section R404.1.4 that deal with additional requirements for foundation walls in certain seismic zones. The building foundation 10 can incorporate certain features from these standards such as tying of the vertical rebar 32 to one or both of the pieces of horizontal rebar 18 in the footing 14.

The aforementioned specifications in section R404.1.1 call for a bond beam in the top row of cells that make up the foundation wall 12. The bond beam includes a piece of horizontally oriented #4 rebar that is located in the upper 12 inches of the foundation wall 12. The building foundation 10 presently disclosed does not have this bond beam present. In this regard, the top row of cells 38 does not have a piece of horizontal rebar therein. The top row of cells 38 may have a configuration the same as that of the bottom or any intermediate row of cells of the foundation wall 12. As such, the cross-sectional shape of at least one of the cells 20 of the top row of cells 38 is the same as the cross-sectional shape of one or more of the cells 20 of a lower row.

A sill 40 rests on the top row of cells 38 of the foundation wall 12. Vertical members, such as the walls of the structure, are built upon the sill 40. The sill 40 includes a sill plate 42, sometimes referred to as a mud sill, that contacts the top row of cells 38. The sill plate 42 covers cells 20 in the top row of cells 38 that are filled with grout 36 and those that are not filled with grout 36. The sill plate 42 can be a piece of treated lumber. Foundation walls 12 are commonly built with a sill plate 42 that is a 2×8. Sill 40 can also include a pair of sill boards 44 and 46 that rest on top of sill plate 42 and are oriented at a 90° angle thereto. Sill boards 44 and 46 may also be pieces of treated lumber. In accordance with one exemplary embodiment, sill boards 44 and 46 are 2×10s. Other exemplary embodiments exist in which sill boards 44 are 2×8s and/or 2×12s.

The seismic strap 24 protrudes from the top row of cells 38 and has an upper portion 28 that engages the sill 40. The sill plate 42 can be notched if necessary in order to position the upper portion 28 against the sill board 46. A series of apertures 30 are defined through the upper portion 28. Nails 48 are driven through apertures 30 and into sill boards 44, 46 in order to attach the seismic strap 24 to the sill 40. In certain exemplary embodiments 9 nails 48 can be driven through sill board 46 and then into sill board 44. In this manner, the seismic strap 24 acts to hold the sill 40, foundation wall 12 and footing 14 to one another during a seismic event. In accordance with other embodiments, the seismic strap 24 may be additionally attached to the sill plate 42. Although described as employing a seismic strap 24, other exemplary embodiments of the present invention are possible in which the building foundation 10 does not have a seismic strap 24. The building foundation shown in FIGS. 1 and 2 can be used in the construction of a brick house. FIG. 2 shows a faced brick wall 50 located adjacent to the foundation wall 12 that makes up the exterior side of the home.

Figure 6:
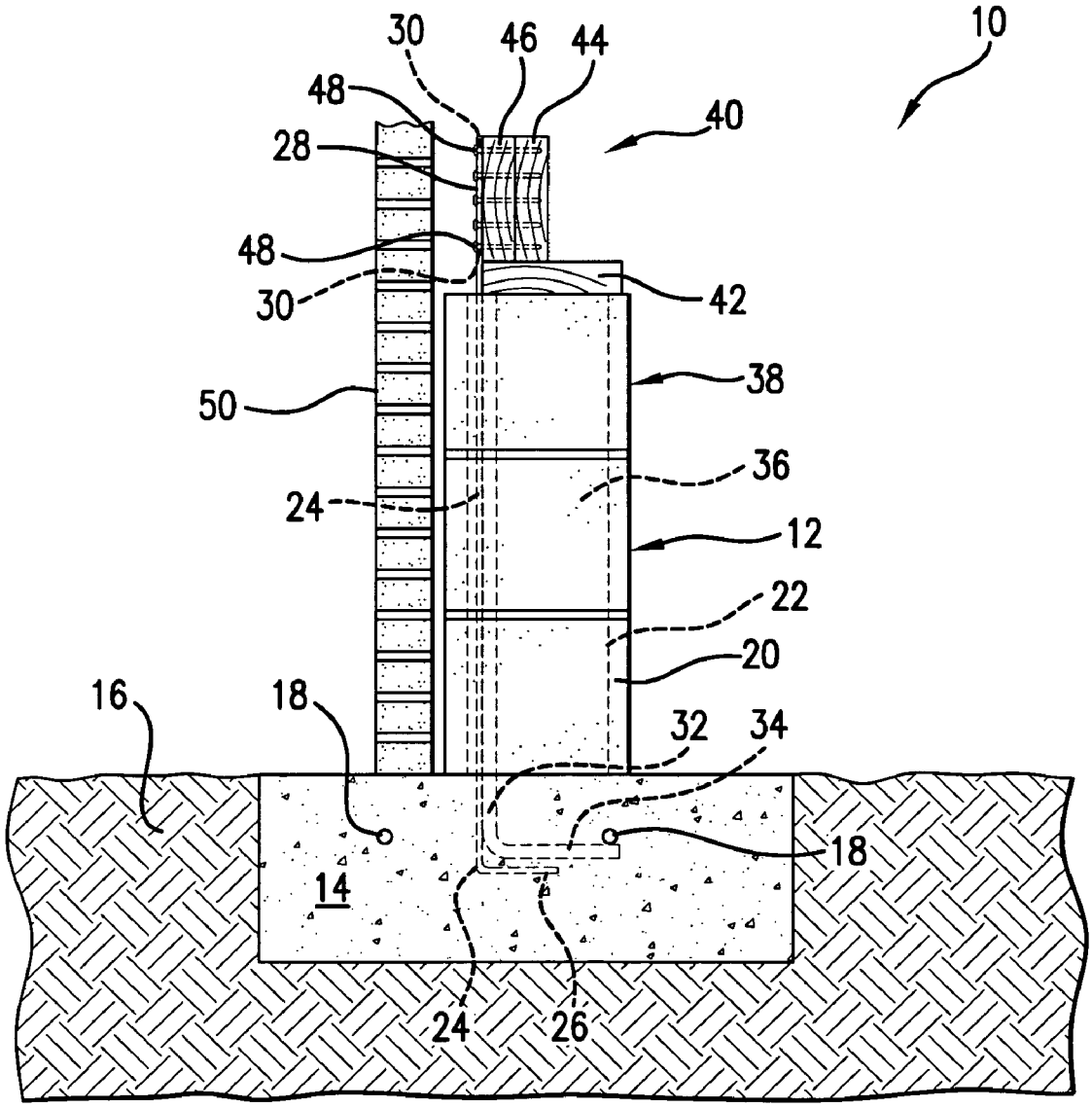
FIG. 6 is a side view of a building foundation in which a seismic strap contacts vertically disposed rebar in accordance with another exemplary embodiment of the present invention.

FIG. 6 illustrates an alternative exemplary embodiment of the building foundation 10 similar to that shown and described in relation to FIGS. 1 and 2. However, the building foundation 10 of FIG. 6 differs in that the seismic strap 24 within the aligned cell cavities 22 contacts the vertically disposed rebar 32.

Figure 3:
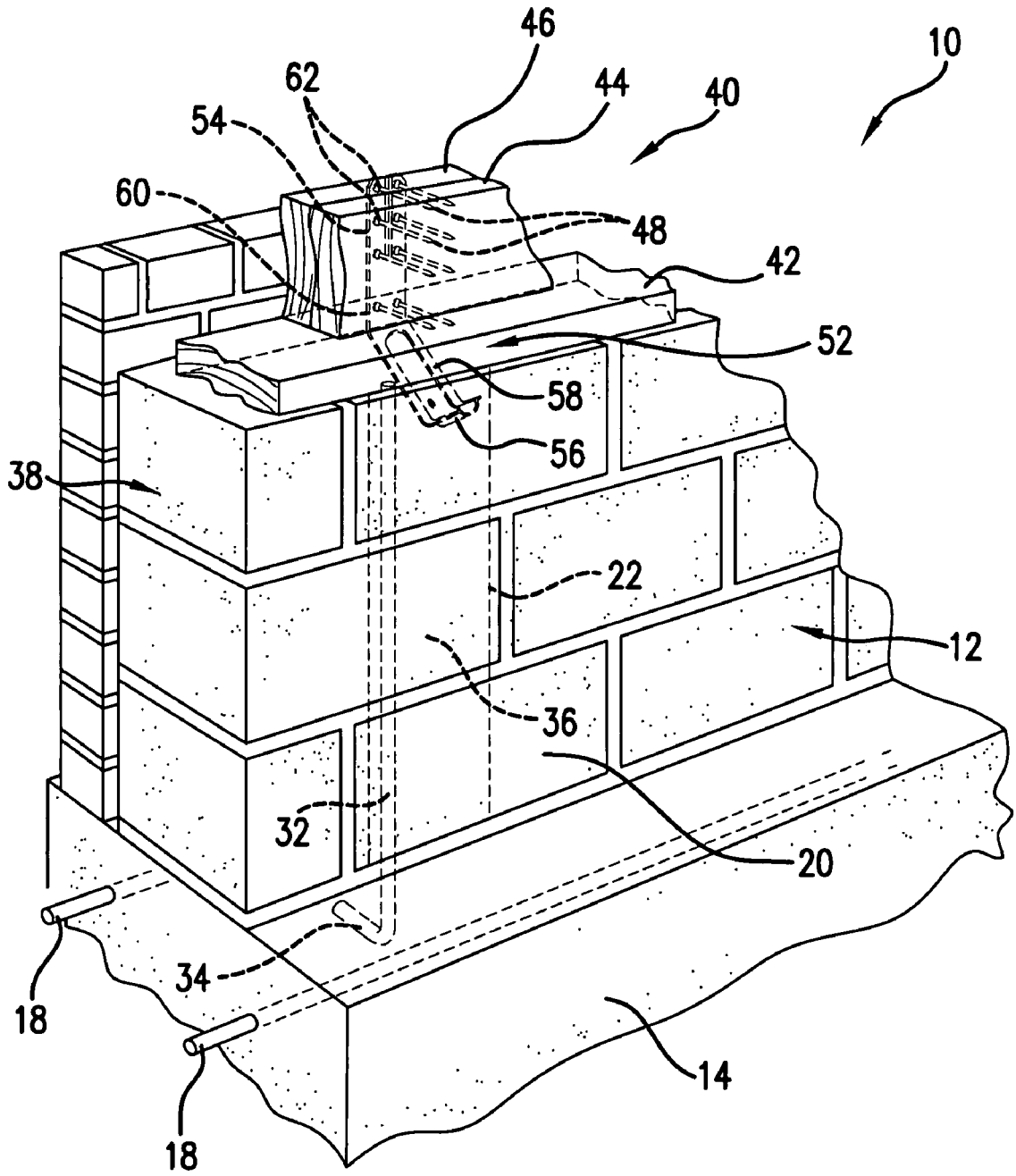
FIG. 3 is a perspective view of a portion of a building foundation that includes a sill anchor in accordance with one exemplary embodiment of the present invention.
Figure 4:
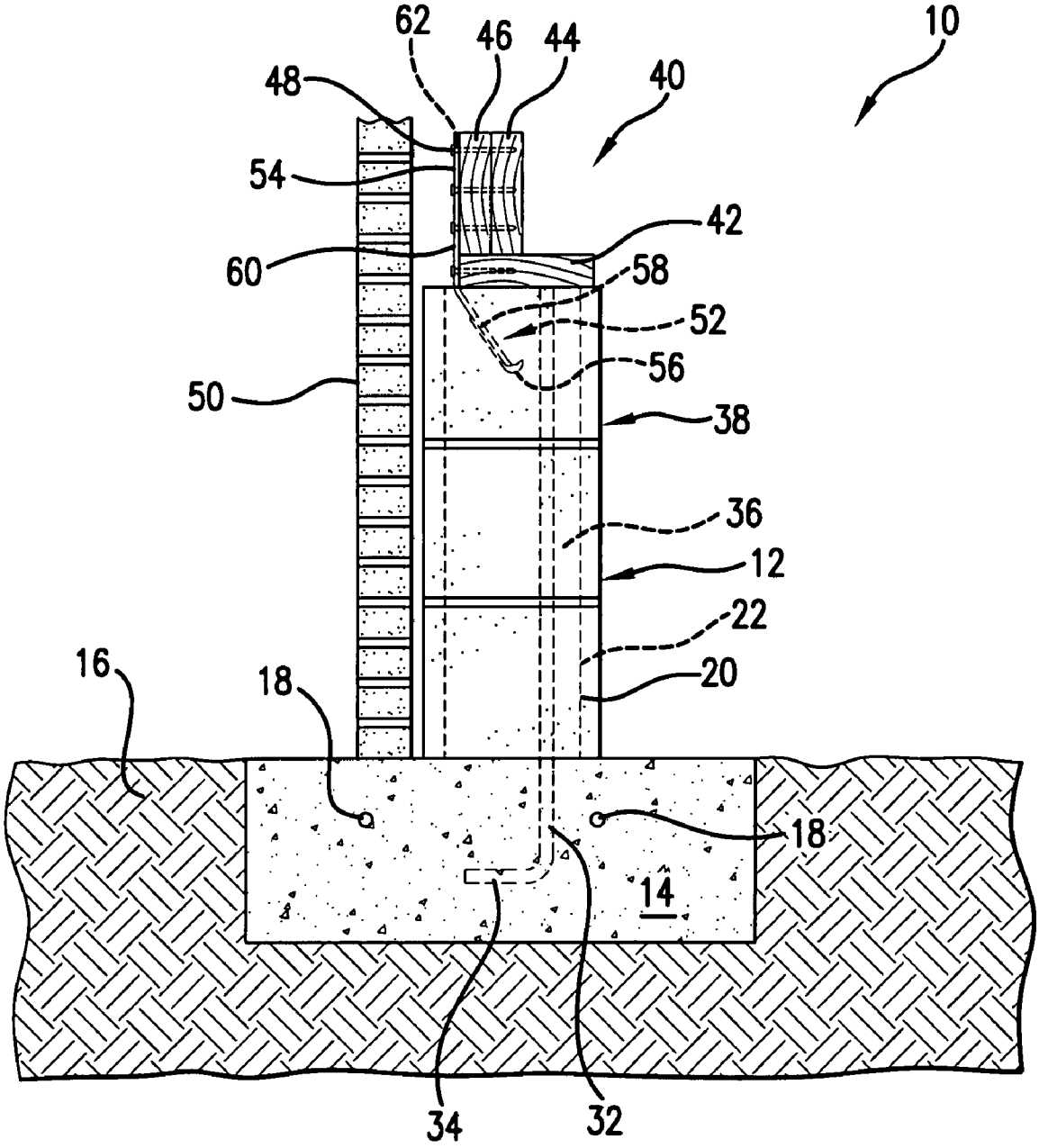
FIG. 4 is a side view of the building foundation of FIG. 1.

FIGS. 3 and 4 show a building foundation 10 in accordance with another exemplary embodiment of the present invention. The building foundation 10 includes some features similar to those previously discussed with respect to the embodiment described in FIGS. 1 and 2. For example, the footing 14 may be a continuous concrete footing and can be constructed as per section R403 and Table R403.1 of the 2003 International Residential Code® set forth by the International Code Council. The exemplary embodiment in FIGS. 3 and 4 can be provided with components sized and selected as those disclosed in the tables and code sections previously mentioned with respect to the exemplary embodiment in FIGS. 1 and 2. A pair of rebar pieces 18 can be #4 type continuous rebar with a minimum 12 inch LAP. The foundation wall 12 can include cells 20 made of 8 inch by 8 inch by 16 inch concrete block per 2003 International Residential Code® R606.5. However, it is to be understood that the blocks can be sized differently in accordance with other exemplary embodiments. The foundation wall 12 of FIGS. 3 and 4 may have a height above grade of 48 inches. In accordance with certain exemplary embodiments, the height of the foundation wall 12 can be up to 108 inches above grade.

The cells 20 may be filled with 2000 psi grout 36. A single piece of vertical rebar 32 is located in the aligned cell cavities 22. Rebar 32 can be #4 type rebar and is located every 4 feet on center along the foundation wall 12 and may be tied to one or more pieces of the horizontal rebar 18 in the footing 14. The height and other properties of the foundation wall 12 can be provided as those set forth in tables R404.1.1(1), R404.1.1(2), R404.1.1(3) and R404.1.1(4) of the 2003 International Residential Code® set forth by the International Code Council.

The building foundation 10 in FIGS. 3 and 4 also includes a sill anchor 52 located in a cavity of a cell 20 in the top row of cells 38. The vertical rebar 32 is present in the same cell 20 cavity as the sill anchor 52. The vertical rebar 32 and sill anchor 52 may or may not contact one another in various embodiments. Further, these two components may or may not be attached to one another in different embodiments of the building foundation 10. Maximum spacing of the sill anchor 52 along the length of the foundation wall 12 is 4 feet on center. In this regard, vertical rebar 32 and a sill anchor 52 may be present every 4 feet on center along the length of the foundation wall 12. The sill anchor 52 may be provided so as to be no more than 1 foot from the corners or ends of the foundation wall 12. The top of vertical rebar 32 can be within ½ an inch of the top of the top row of cells 38. The vertical rebar 32 is encased within the grout 36 and thus does not protrude from the top of cells 20.

In accordance with one exemplary embodiment, the sill anchor 52 can be a MAS sill plate to foundation anchor such as one provided by Simpson Manufacturing having offices at 5956 W. Las Positas Blvd., Pleasanton, Calif. 94588. In accordance with one exemplary embodiment of the present invention, the sill anchor 52 is a mud sill anchor such as that described in U.S. Pat. No. 4,413,456 entitled "Mud Sill Anchor" whose inventor is Tyrell T. Gilb. The entire contents of U.S. Pat. No. 4,413,456 are incorporated by reference herein in their entirety for all purposes. The aforementioned mud sill anchors are embedded into the slab of a slab foundation and anchor the mudsill to the slab.

The sill anchor 52 may be a Simpson MAS or MASB anchor placed within the cells 38 next to the vertical rebar 32 that can be #4 rebar. Sill anchors 52 can be spaced every 4 feet from center to center and may be 1 foot from the corners or ends. Pressure treated wood may be used in the construction of the sill 40 and also for an interior brace wall. The sill anchors 52 can be spaced so as not to exceed 6 feet from center to center when used on the interior brace wall. A faced brick wall 50 may be included with 8 inch Durawire for each course of block and brick ties as set forth in section R703.7 of the 2003 International Residential Code®.

Figure 5:
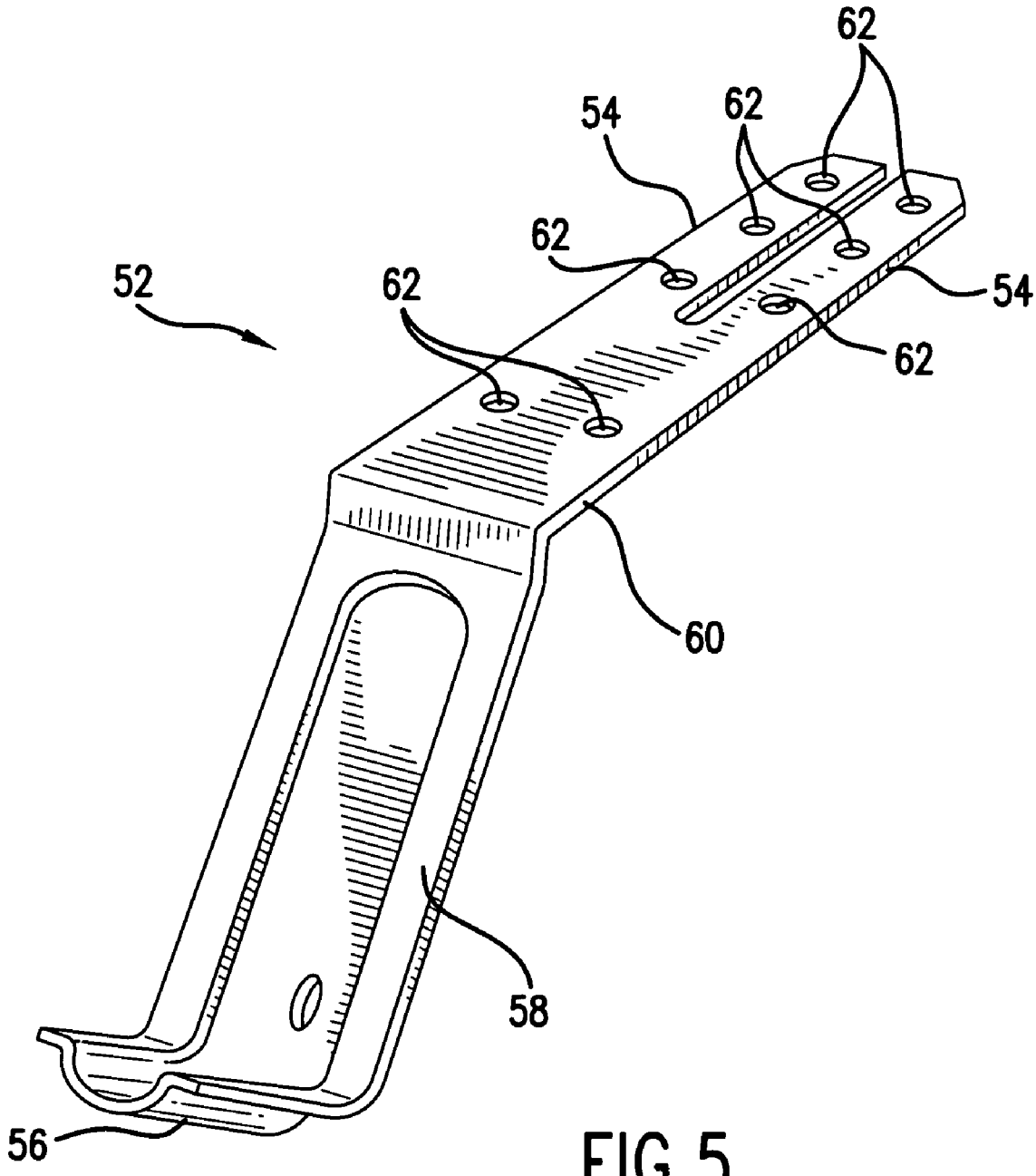
FIG. 5 is a perspective view of a sill anchor that can be used in various exemplary embodiments of the present invention.

One embodiment of the sill anchor 52 is shown in greater detail in FIG. 5. The sill anchor 52 has an elongated portion 58 with a hooked end 56. The sill anchor 52 can be made of steel in accordance with one embodiment. A formable portion 60 is located on the end of elongated portion 58 opposite hooked end 56. Formable portion 60 includes a pair of ears 54 that define a plurality of apertures 62. Formable portion 60 can be bent or otherwise formed by a user into a desired shape.

Referring back to FIGS. 3 and 4, the sill anchor 52 is embedded in grout 36 in a cell cavity in the top row of cells 38. The elongated portion 58 extends at an angle to the vertical rebar 32 in the cell cavity in the top row of cells 38. The elongated portion 58 may extend at an angle from 25° to 65° to the vertical rebar 32 in accordance with various exemplary embodiments. The hooked end 56 is also embedded in the grout 36. Formable portion 60 extends upward from and out of the top row of cells 38. Formable portion 60 can be bent so as to be positioned proximate to the side of a sill plate 46 of sill 40. The sill 40 and associated sill plate 42, sill board 44 and sill board 46 can be provided and arranged in manners similar to those previously discussed with respect to the exemplary embodiments of FIGS. 1 and 2. It is likewise to be understood that the sill 40 in all embodiments need not have any or all the displayed components such as the sill plate 42, sill board 44 and/or sill board 46. Nails 48 can be driven through apertures 62 of the ears 54 of sill anchor 52 in order to attach sill anchor 52 to the sill plate 46. The nails 48 are driven through the sill plate 46 and into sill plate 44. In accordance with one embodiment 8 nails 48 are used to attach the sill anchor 52. Nails 48 can also be driven into the sill plate 42 in order to attach the sill anchor 52 thereto if desired in accordance with other embodiments. Attachment to sill anchor 52 causes sill 40 to be firmly rooted to the foundation wall 12.

As with the previously described exemplary embodiment, the building foundation 10 in FIGS. 3 and 4 does not include a bond beam, or associated components such as horizontal rebar, in the top row of cells 38. Consequently, the cells 20 making up the top row of cells 38 have the same cross-sectional shape as those making up subsequent rows of the foundation wall 12. Unlike the exemplary embodiment shown in FIGS. 1 and 2, the building foundation 10 in FIGS. 3 and 4 does not employ seismic straps 24.

Although not shown in the previous figures for sake of clarity, the building foundation 10 may include horizontal joint reinforcements in each course as is commonly known in building foundation designs. The joint reinforcement can be 12 inch Durabond Wire® without wall ties. Alternatively the joint reinforcement can be 8 inch wire with corrugated wall ties within a 2 foot by 2 foot square. Such wire may be as that supplied by Durbond Products Limited having offices at 55 Underwriters Road, Scarborough, Ontario, Canada M1R 3B4. The masonry cement employed in construction of the foundation wall 12 may be Holcim® type S masonry cement manufactured by Holcim Inc., having offices at 6211 North Ann Arbor Road, Dundee, Mich., 48131. It is to be understood that this is but one type of masonry cement that can be employed and that other types are possible in accordance with other embodiments.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. A building foundation, comprising:

a footing;

a foundation wall supported by said footing, said foundation wall having a plurality of cells arranged so as to define aligned cell cavities at least some of which are filled in with grout, wherein at least some of said cells of the top row of cells of said foundation wall have a cross-sectional shape that is the same as at least some of said cells of a lower row of cells of said foundation wall, wherein said foundation wall has an interior surface that faces towards the interior of the building foundation and an exterior surface that faces away from the interior of the building foundation;

a seismic strap at least partially located in at least one set of said aligned cell cavities filled in with grout, wherein said seismic strap is embedded in said footing;

a sill supported by said foundation wall, wherein said seismic strap is attached to said sill;

horizontally disposed rebar located in said footing; and vertically disposed rebar located in said set of aligned cell cavities filled in with grout in which said seismic strap is located, wherein all of said cells forming said set of said aligned cell cavities into which said vertically disposed rebar is located have the same size and cross-sectional shape extending along their lengths, wherein said vertically disposed rebar is a single continuous integral piece of rebar that extends from said footing to said top row of cells, wherein said vertically disposed rebar contacts said horizontally disposed rebar and is located in said top row of cells and is embedded in said grout in said top row of cells and does not extend above said top row of cells and is not attached to said sill;

wherein said grout in said set of said aligned cell cavities that includes said seismic strap is located between said footing and said sill, wherein said grout is completely located within said set of aligned cell cavities that includes said vertical rebar such that said grout is not visible on said interior surface of said foundation wall and is not visible on said exterior surface of said foundation wall.

2. The building foundation as set forth in claim 1, further comprising:

an additional piece of horizontally disposed rebar located in said footing.

3. The building foundation as set forth in claim 2, wherein said seismic strap contacts said vertically disposed rebar.

4. The building foundation as set forth in claim 1, further comprising a faced brick wall supported by said footing.

5. The building foundation as set forth in claim 1, wherein a plurality of seismic straps are located along at least a portion of the length of said foundation wall and are located a distance of 6 feet on center from one another, and wherein said plurality of seismic straps are located in sets of aligned cell cavities filled in with grout.

6. The building foundation as set forth in claim 1, wherein said sill has a sill plate that contacts said top row of cells of said foundation wall.

7. A building foundation, comprising:

a footing;

a foundation wall supported by said footing, said foundation wall having a plurality of cells, wherein the top row of cells of said foundation wall does not include a bond beam and wherein said foundation wall does not include a seismic strap therein, wherein said plurality of cells define a set of aligned cell cavities, wherein said foundation wall has an interior surface that faces towards the interior of the building foundation and an exterior surface that faces away from the interior of the building foundation;

a sill anchor at least partially located in said foundation wall, wherein said sill anchor is configured for attachment to a sill, wherein said sill anchor is at least partially located in an upper cell of said set of aligned cell cavities, wherein said sill anchor is not embedded in said footing and does not extend to a row of cells located below and contacting the top row of cells;

vertically disposed rebar embedded in said footing and located in every cell of said set of aligned cell cavities, wherein the top three cells of said set of aligned cell cavities have the same size and cross-sectional shape extending along their lengths, wherein said vertically disposed rebar is a single continuous integral piece of rebar that extends from said footing to said top row of cells; and grout located in said set of aligned cell cavities, wherein said grout in said set of aligned cell cavities does not form a portion of said interior surface of said foundation wall.

8. The building foundation as set forth in claim 7, wherein said cavities.

9. The building foundation as set forth in claim 8, wherein said vertically disposed rebar is embedded in grout that fills said set of aligned cell cavities.

10. The building foundation as set forth in claim 7, wherein said foundation wall has a height up to 108 inches.

11. The building foundation as set forth in claim 7, further comprising a sill having a sill plate that contacts said top row of cells of said foundation wall, wherein said sill anchor is attached to said sill and to said foundation wall in order to effect attachment of said sill to said foundation walls wherein said vertically disposed rebar is embedded in said grout in said top row of cells and does not extend above said top row of cells and is not attached to said sill.

12. The building foundation as set forth in claim 7, wherein said sill anchor has an elongated portion with a hooked end, and wherein said sill anchor has a formable portion that includes a pair of ears that are capable of being formed.

13. The building foundation as set forth in claim 12, wherein said hooked end of said sill anchor is embedded in grout that is included in said foundation wall, and wherein said ears of said sill anchor are located outside of said foundation wall and have a plurality of apertures configured for receipt of nails for use in attaching said ears to a sill supported by said foundation wall.

14. The building foundation as set forth in claim 7, wherein a plurality of sill anchors are located along at least a portion of the length of said foundation wall and are located a distance of 4 feet on center from one another, and wherein said plurality of sill anchors are located in sets of aligned cell cavities filled in with grout.

15. A building foundation, comprising:

a footing;

a foundation wall supported by said footing, said foundation wall having a plurality of cells arranged to define a set of aligned cell cavities, wherein said plurality of cells are arranged to define a top row of cells, wherein at least some of said cells of said top row of cells have a cross-sectional shape that is the same as at least some of said cells of a lower row of cells of said foundation wall that are two rows from said top row of cells, wherein said foundation wall has an interior surface that faces towards the interior of the building foundation and an exterior surface that faces away from the interior of the building foundation;

a sill anchor at least partially located in the upper cell of said set of aligned cell cavities of said foundation wall, wherein grout is disposed in said set of aligned cell cavities between said sill anchor and said footing, and wherein said sill anchor is configured for attachment to a sill, wherein said sill anchor is not embedded in said footing and does not extend to a row of cells that are two rows from said top row of cells;

vertically disposed rebar embedded in said footing and located in said set of aligned cell cavities, wherein the top three cells of said set of aligned cell cavities have the same size and cross-sectional shape extending along their length, wherein said vertically disposed rebar is a single continuous integral piece of rebar that extends from said footing to said top row of cells; and grout located in said set of aligned cell cavities, wherein said grout in said set of aligned cell cavities does not form a portion of said interior surface of said foundation wall.

16. The building foundation as set forth in claim 15, wherein said vertically disposed rebar is embedded in grout in said top row of cells of said set of aligned cell cavities, wherein said vertically disposed rebar does not extend above said top row of cells.

17. The building foundation as set forth in claim 16, further comprising at least two pieces of horizontally disposed rebar located in said footing, and wherein said vertically disposed rebar is tied to and contacts at least one of said horizontally disposed rebar.

18. The building foundation as set forth in claim 15, further comprising a faced brick wall supported by said footing.

19. The building foundation as set forth in claim 15, wherein said foundation wall does not include a seismic strap therein.

20. The building foundation as set forth in claim 15, wherein said sill anchor has a hooked end and a formable portion with a pair of ears, wherein said hooked end of said sill anchor is embedded in grout that is included in said foundation wall, and wherein said ears of said sill anchor are located outside of said foundation wall and have a plurality of apertures configured for receipt of nails for use in attaching said ears to a sill supported by said foundation wall.

21. A building foundation, comprising:

a footing;

a foundation wall supported by said footing, said foundation wall having a plurality of cells arranged to define a set of aligned cell cavities, wherein said foundation wall does not have a bond beam, wherein said foundation wall has an interior surface that faces towards the interior of the building foundation and an exterior surface that faces away from the interior of the building foundation;

a sill supported by said foundation wall;

rebar at least partially located in said foundation wall, wherein said rebar is oriented vertically and is embedded in said footing and is located in said set of aligned cell cavities, wherein the top three of said cells forming said set of said aligned cell cavities into which said rebar is located have the same size and cross-sectional shape extending along their lengths, wherein said rebar is a single continuous integral piece of rebar that extends from said footing to said top row of cells; and grout that is located within said set of aligned cell cavities that includes said rebar, wherein said grout is not visible on said interior surface of said foundation wall and is not visible on said exterior surface of said foundation wall.

22. The building foundation as set forth in claim 21, wherein said rebar is embedded in grout in said set of aligned cell cavities, and wherein said rebar is attached to said sill; and further comprising horizontal rebar that is embedded in said footing and that contacts and is tied to said rebar that is oriented vertically.

23. The building foundation as set forth in claim 21, wherein said sill has a sill plate, and wherein said rebar is attached to said sill plate of said sill.

24. The building foundation as set forth in claim 21, wherein said rebar is attached to said sill through the use of a sill anchor that contacts said rebar.

* * * * *

UNITED STATES PATENT AND TRADEMARK OFFICE

CERTIFICATE OF CORRECTION

PATENT NO. : 7,591,110 B2
APPLICATION NO. : 11/705200
DATED : September 22, 2009
INVENTOR(S) : Jody B. Lane It is certified that error appears in the above-identified patent and that said Letters Patent is hereby corrected as shown below:

In claim 8 at line 19, the phrase "said cavities" should read --said sill anchor is embedded in grout that fills said set of aligned cell cavities--

Signed and Sealed this

Eighth Day of December, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,591,110 B2
APPLICATION NO. : 11/705200
DATED : September 22, 2009
INVENTOR(S) : Jody B. Lane It is certified that error appears in the above-identified patent and that said Letters Patent is hereby corrected as shown below:

Column 10, In claim 8 at line 19, the phrase "said cavities" should read --said sill anchor is embedded in grout that fills said set of aligned cell cavities--

This certificate supersedes the Certificate of Correction issued December 8, 2009.

Signed and Sealed this

Twenty-sixth Day of January, 2010

David J. Kappos

David J. Kappos
*Director of the United States Patent and Trademark Office*